US008863420B2

(12) United States Patent
Edmondson et al.

(10) Patent No.: US 8,863,420 B2
(45) Date of Patent: Oct. 21, 2014

(54) THREE-DIMENSIONAL SUPPORTING FRAME

(75) Inventors: David Edmondson, San Diego, CA (US); Arunkumar Madanagopal, San Diego, CA (US); Francois K Pirayesh, San Diego, CA (US); Xiaoqi Zhou, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 306 days.

(21) Appl. No.: 13/405,212

(22) Filed: Feb. 24, 2012

(65) Prior Publication Data

US 2013/0219761 A1 Aug. 29, 2013

(51) Int. Cl.

| | |
|---|---|
| ***A47G 1/06*** | (2006.01) |
| ***B65D 5/00*** | (2006.01) |
| *B65D 5/22* | (2006.01) |

(52) U.S. Cl.

CPC .... *A47G 1/06* (2013.01); *B65D 5/22* (2013.01)
USPC ..... 40/743; 40/773; 40/788; 40/786; 40/798; 40/782; 40/783; 40/784; 40/785; 206/453; 229/167; 229/168

(58) Field of Classification Search

CPC ..... A47G 1/06; A47G 1/12; B65D 5/22
USPC ..... 40/773, 782–786, 788, 798, 743; 206/453; 229/167, 168
See application file for complete search history.

(56) References Cited

U.S. PATENT DOCUMENTS

| | | | | |
|---|---|---|---|---|
| 2,085,097 | A | 6/1937 | Hansen | |
| 2,146,318 | A | 2/1939 | Viscount | |
| RE22,683 | E | 10/1945 | Piper | |
| 2,851,208 | A | 9/1958 | Samsing | |
| 3,053,001 | A | 9/1962 | Allen | |
| 3,214,855 | A | 11/1965 | Winkler et al. | |
| 3,240,130 | A | 3/1966 | Neff | |
| 3,733,809 | A | 5/1973 | Reiter et al. | |
| 3,765,598 | A * | 10/1973 | Rosenburg, Jr. | 229/168 |

(Continued)

FOREIGN PATENT DOCUMENTS

| | | |
|---|---|---|
| DE | 3701293 | 4/1988 |
| GB | 589621 | 6/1947 |

(Continued)

OTHER PUBLICATIONS

Yang, H., "Fundamentals, Preparation , and Characterization of Superhydrophobic Wood Fiber Products", Thesis, 2008, Georgia Institute of Technology, 95 pages.

*Primary Examiner* — Syed A Islam

(57) ABSTRACT

A three-dimensional supporting frame includes a blank. The blank includes an image receiving surface, a back surface opposed to the image receiving surface, a center portion defining a perimeter, and at least three foldable extensions extending from the perimeter. Each of the foldable extensions includes no less than four folds to be folded toward the back surface to form the three-dimensional supporting frame. A tab line is scored in one of the folds of each of the at least three foldable extensions, the tab line to be released to form a tab to be secured to the back surface when the folds are folded. An adhesion promoting layer is present on the back surface at the center portion.

15 Claims, 5 Drawing Sheets

(56) References Cited

U.S. PATENT DOCUMENTS

| | | | | |
|---|---|---|---|---|
| 4,112,604 | A | 9/1978 | Ott et al. | |
| 4,145,465 | A * | 3/1979 | Sanderson et al. | 428/31 |
| 4,279,087 | A | 7/1981 | Crawford | |
| 4,738,041 | A | 4/1988 | Drueck, Jr. | |
| 4,870,766 | A | 10/1989 | Topping | |
| 5,032,436 | A | 7/1991 | Gustafson | |
| 5,255,458 | A | 10/1993 | Piel | |
| 5,359,794 | A | 11/1994 | Wood | |
| 5,513,455 | A * | 5/1996 | Walker | 40/788 |
| 5,678,339 | A | 10/1997 | Marventano | |
| 5,679,145 | A | 10/1997 | Andersen et al. | |
| 5,683,772 | A | 11/1997 | Andersen et al. | |
| 5,947,437 | A | 9/1999 | Tate et al. | |
| 5,950,341 | A | 9/1999 | Cross | |
| 5,974,714 | A | 11/1999 | Jones | |
| 6,177,516 | B1 | 1/2001 | Hudak | |
| 6,265,037 | B1 | 7/2001 | Godavarti et al. | |
| 6,427,371 | B2 | 8/2002 | Olson et al. | |
| 6,475,713 | B1 | 11/2002 | Aylward et al. | |
| 6,541,852 | B2 | 4/2003 | Beroz et al. | |
| 6,649,245 | B2 | 11/2003 | Lenderink | |
| 6,883,908 | B2 | 4/2005 | Young et al. | |
| 7,818,904 | B2 | 10/2010 | Wagner | |
| 7,851,391 | B2 | 12/2010 | Bond et al. | |
| 7,918,047 | B1 | 4/2011 | Ngan | |
| 2002/0144445 | A1 | 10/2002 | Gomez del Campo Diaz Barrerio | |
| 2003/0129361 | A1 | 7/2003 | Plug et al. | |
| 2004/0159031 | A1 | 8/2004 | Chang | |
| 2006/0189236 | A1 | 8/2006 | Davis et al. | |
| 2009/0098362 | A1 * | 4/2009 | Wang et al. | 428/325 |
| 2009/0229157 | A1 | 9/2009 | Mehler | |
| 2010/0196603 | A1 | 8/2010 | Ohshima et al. | |
| 2011/0016759 | A1 * | 1/2011 | Ramos-Gonzalez et al. | 40/773 |
| 2011/0088294 | A1 | 4/2011 | Docking | |

FOREIGN PATENT DOCUMENTS

| | | |
|---|---|---|
| GB | 726212 | 3/1955 |
| GB | 1040995 | 9/1966 |
| GB | 1439323 | 6/1976 |
| GB | 2104378 | 3/1983 |
| GB | 2220854 | 1/1990 |
| GB | 2296866 | 7/1996 |
| GB | 2376916 | 12/2002 |
| GB | 2461863 | 1/2010 |

* cited by examiner

THREE-DIMENSIONAL SUPPORTING FRAME

BACKGROUND

The global print market is in the process of transforming from analog printing to digital printing. Inkjet printing and electrophotographic printing are examples of digital printing techniques. These printing techniques have become increasingly popular for printing photographs and/or decorative art items. As examples, an image may be inkjet printed on canvas and then mounted on a wood frame, or an image may be liquid electro-photographically printed on a high gloss medium and then mounted on a metal plate.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

The present disclosure relates generally to a three-dimensional supporting frame.

Examples of the art frame disclosed herein are suitable for displaying photographs, art images, graphics, text, and/or the like, and/or combinations thereof. The base of the art frame is a three-dimensional supporting frame, which is made up of a folded blank. The blank is configured so that when folded, three-dimensional frame portions are created. As will be described in more detail herein, particular areas of each frame portion are secured to a center portion of the blank to create the three-dimensional supporting frame. In the examples disclosed herein, an adhesion promoting layer is applied to the blank to enhance the adhesion joints between the center portion and i) each of the frame portions and ii) the tabs.

Enhanced adhesion joints enable the three-dimensional supporting frame, and thus the art frame, to maintain its original shape.

Figure 1A:
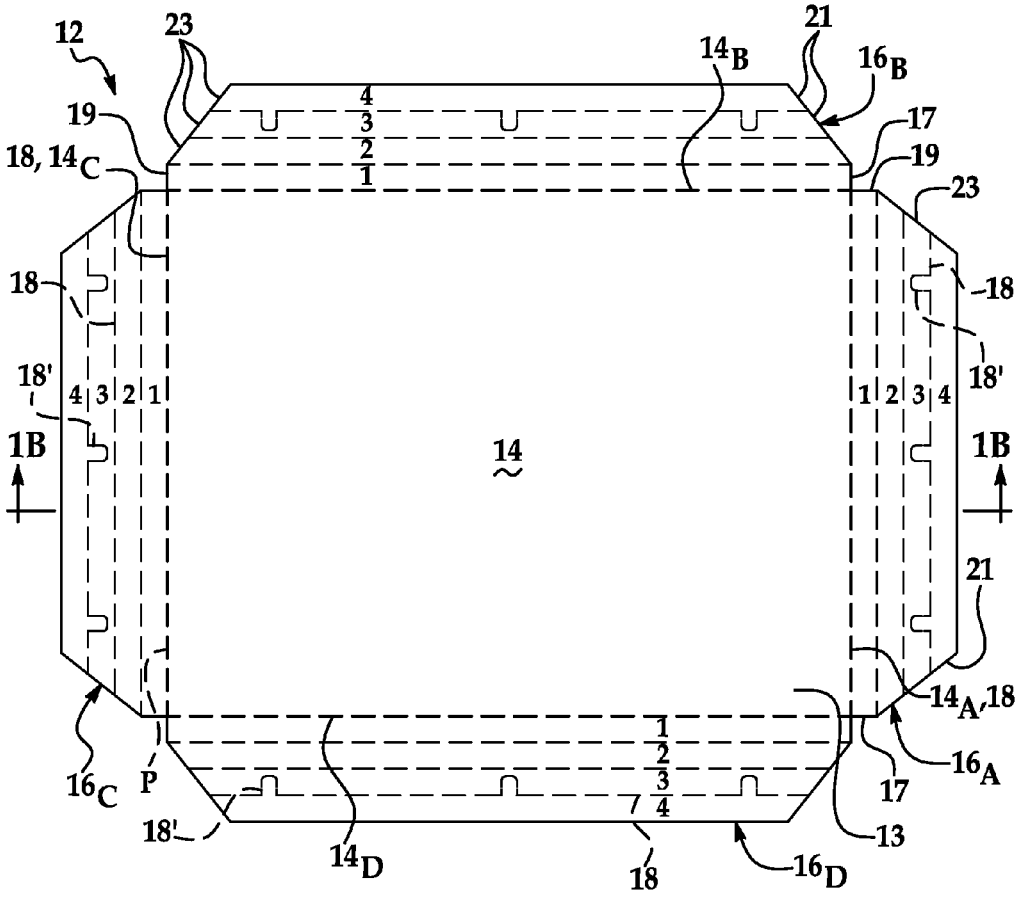
FIG. 1A is a front view of an example of a foldable material used to form an example of a three-dimensional supporting frame.

Referring now to FIG. 1A, an example of a blank 12 is depicted. The blank 12 is pre-cut and scored so that when it is folded, it forms the three-dimensional supporting frame 20 (see FIG. 1D). While the blank 12 shown in FIG. 1A is used to make a rectangular three-dimensional supporting frame 20, it is to be understood that blank 12 may be pre-cut and scored to have any desirable shape. As examples, the blank 12 may be shaped so that when folded, any of the following three-dimensional supporting frames is formed: a square three-dimensional supporting frame, a triangular three-dimensional supporting frame (20' in FIG. 3), a circular three-dimensional supporting frame (20" in FIG. 4), or a polygonal three-dimensional supporting frame (20''' in FIG. 5).

FIG. 1A is a front view of the blank 12, which has a center portion 14 that includes at least four sides $\mathbf{14}_A$, $\mathbf{14}_B$, $\mathbf{14}_C$, $\mathbf{14}_D$ which define a perimeter P. When the center portion 14 has four sides $\mathbf{14}_A$, $\mathbf{14}_B$, $\mathbf{14}_C$, $\mathbf{14}_D$, the center portion 14 may be square, rectangular, or circular. When the center portion 14 has three sides, the shape of the center portion 14 is a triangle, and when the center portion 14 has more than four sides, the shape of the center portion 14 will depend upon the number of sides (e.g., five sides correspond with a pentagon shaped center portion 14, six sides correspond with a hexagon shaped center portion 14, etc.).

The blank 12 also has two opposed surfaces, namely an image receiving surface 13 (FIGS. 1A and 1B) and a back surface 15 (FIGS. 1B, 1C and 1D) that is opposed to the image receiving surface 13.

A foldable extension $\mathbf{16}_A$, $\mathbf{16}_B$, $\mathbf{16}_C$, $\mathbf{16}_D$ respectively extends from each side $\mathbf{14}_A$, $\mathbf{14}_B$, $\mathbf{14}_C$, $\mathbf{14}_D$ of the center portion 14. The foldable extensions $\mathbf{16}_A$, $\mathbf{16}_B$, $\mathbf{16}_C$, $\mathbf{16}_D$ may be scored with fold lines 18 that are meant to guide the folding of the foldable extensions $\mathbf{16}_A$, $\mathbf{16}_B$, $\mathbf{16}_C$, $\mathbf{16}_D$ toward the back surface 15 of the center portion 14. In an example, each foldable extension $\mathbf{16}_A$, $\mathbf{16}_B$, $\mathbf{16}_C$, $\mathbf{16}_D$ has no less than four fold lines 18 defining no less than four respective folds. In the example shown in FIG. 1A, there are four folds 1, 2, 3, 4. In this example then, each foldable extension $\mathbf{16}_A$, $\mathbf{16}_B$, $\mathbf{16}_C$, $\mathbf{16}_D$ is foldable four times, once along each scored fold line 18. In other examples, it is to be understood that more than four fold lines 18 may be included on any one foldable extension $\mathbf{16}_A$, $\mathbf{16}_B$, $\mathbf{16}_C$, $\mathbf{16}_D$ so that the foldable extension $\mathbf{16}_A$, $\mathbf{16}_B$, $\mathbf{16}_C$, $\mathbf{16}_D$ is foldable more than four times.

Figure 1B:
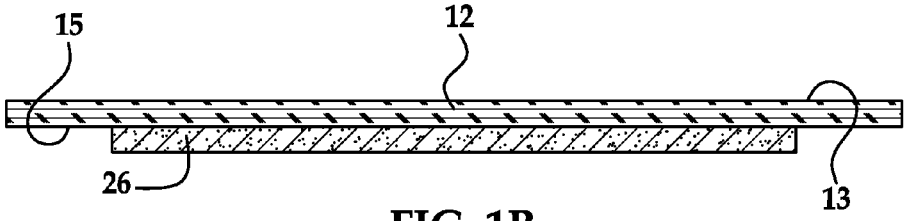
FIG. 1B is a semi-schematic, cross-sectional view taken along line 1B-1B in FIG. 1A.
Figure 1C:
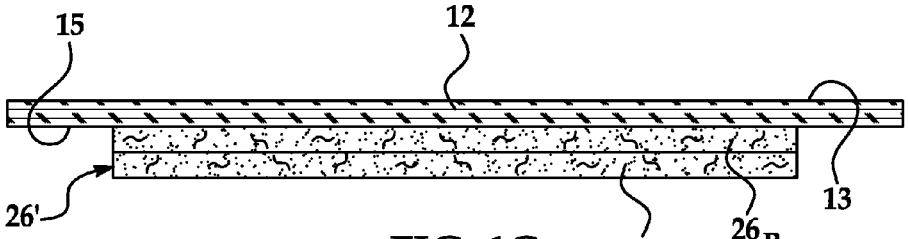
FIG. 1C is a semi-schematic, cross-sectional view of another example of the foldable material.
Figure 1D:
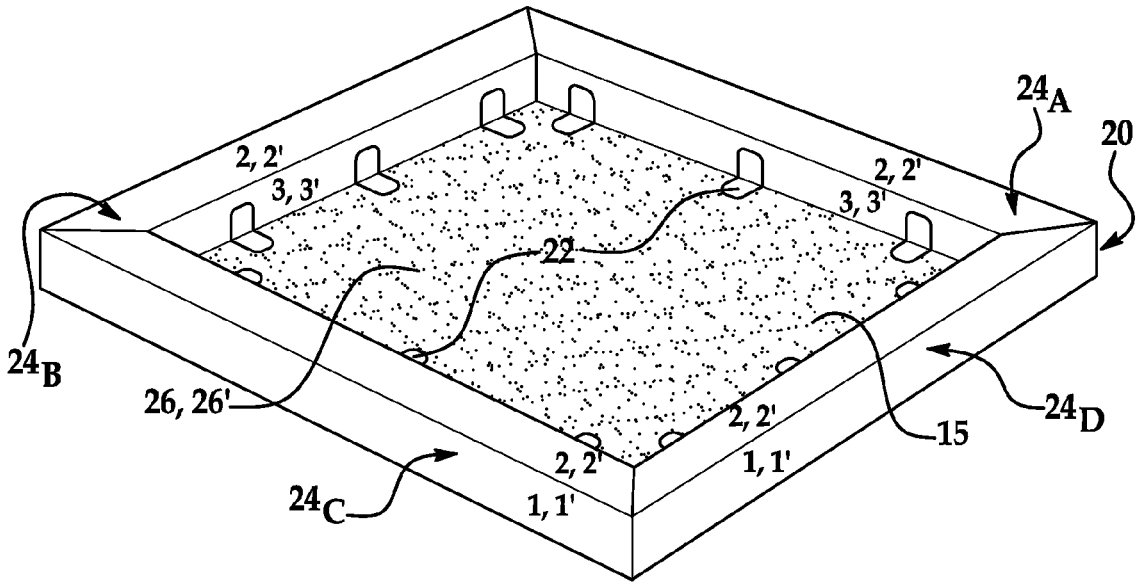
FIG. 1D is a back perspective view of the three-dimensional supporting frame formed from the foldable material of FIG. 1A.

In this example, the outermost fold line 18 defining the fold 4 and part of the fold 3 also defines a tab line 18'. The tab line 18' may be scored so that when the folds 4 are folded, a tab 22 (FIG. 1D) disconnects (either automatically or with application of a small force) along the tab line 18'. The tab 22 can then be folded toward and secured to the surface 15 (FIG. 1D). The tabs 22 will be further discussed in reference to FIGS. 2 and 3. While three tab lines 18' are shown on each foldable extension $\mathbf{16}_A$, $\mathbf{16}_B$, $\mathbf{16}_C$, $\mathbf{16}_D$, it is to be understood that any number of tab lines 18' may be formed. The number of tab lines 18' may depend upon the desired balance between maximizing adhesion between frame portions ($\mathbf{24}_A$, $\mathbf{24}_B$, $\mathbf{24}_C$, and $\mathbf{24}_D$ in FIG. 1D) and the center portion 14 when the blank 12 is folded and maintaining the strength of the frame portions $\mathbf{24}_A$, $\mathbf{24}_B$, $\mathbf{24}_C$, and $\mathbf{24}_D$ when the tabs 22 are released and secured to the center portion 14.

The foldable extensions $\mathbf{16}_A$, $\mathbf{16}_B$, $\mathbf{16}_C$, $\mathbf{16}_D$ and the folds 1, 2, 3, 4 may have any suitable shape that allows the folds 1, 2, 3, 4 of the respective foldable extension $\mathbf{16}_A$, $\mathbf{16}_B$, $\mathbf{16}_C$, $\mathbf{16}_D$ to be folded toward the surface 15 to form a three-dimensional frame portion $\mathbf{24}_A$, $\mathbf{24}_B$, $\mathbf{24}_C$, and $\mathbf{24}_D$ (FIG. 1D). As shown in FIG. 1A, each of the foldable extensions $16_A$, $16_B$, $16_C$, $16_D$ is partially angled at opposed edges so that when the folds 1, 2, 3, 4 are folded, the resulting frame portion $24_A$, $24_B$, $24_C$, and $24_D$ abuts an adjacent frame portion. As shown in FIG. 1A, the innermost fold 1 of each foldable extension $16_A$, $16_B$, $16_C$, $16_D$ has opposed edges 17, 19 that are perpendicular with respect to the respective side $14_A$, $14_B$, $14_C$, $14_D$ of the center portion 14 from which the foldable extension $16_A$, $16_B$, $16_C$, $16_D$ extends. Said another way, the innermost fold 1 has opposed edges 17, 19 that are perpendicular with respect to the portion of the perimeter P at the respective foldable extension $16_A$, $16_B$, $16_C$, $16_D$. For example, edges 17 and 19 of foldable extension $16_B$ are each perpendicular to the side $14_B$ (i.e., to the perimeter P at the extension $16_B$). Also as shown in FIG. 1A, the other folds 2, 3, 4 of each foldable extension $16_A$, $16_B$, $16_C$, $16_D$ have opposed edges 21, 23 that are angled with respect to the respective side $14_A$, $14_B$, $14_C$, $14_D$ of the center portion 14 from which the foldable extension $16_A$, $16_B$, $16_C$, $16_D$ extends. Said another way, the other folds 2, 3, 4 have opposed edges 21, 23 that are angled with respect to the portion of the perimeter P at the respective foldable extension $16_A$, $16_B$, $16_C$, $16_D$. As examples, edge 21 of foldable extension $16_B$ is angled about 135° with respect to the side $14_B$ (i.e., to the perimeter P at the extension $16_B$), and edge 23 of foldable extension $16_B$ is angled about 45° with respect to the side $14_B$ (i.e., to the perimeter P at the extension $16_B$). The angles of the edges 21, 23 of the other folds 2, 3, 4 may change when the blank 12 has a different number of foldable extensions $16_A$, $16_B$, $16_C$, $16_D$. Any desirable angle may be used, as long as adjacent edges 21, 23 abut one another to form corners when the blank 12 is folded to form the three-dimensional frame portions $24_A$, $24_B$, $24_C$, and $24_D$.

The blank 12 may be made of any foldable material with suitable stiffness that can be folded over at least 90° with the assistance of scoring without cracking and/or breaking. The stiffness of the blank 12, when it is made from a cellulose-based paper board, is greater than 25 Taber units (gf-cm). In an example, the stiffness of the blank 12 ranges from about 100 Taber units to about 3000 Taber units (TAPPI method T489-om). In another example, the stiffness of the blank 12 ranges from about 500 Taber units to about 2000 Taber units (TAPPI method T489-om). Stiffness, k, of a body is a measure of the resistance offered by an elastic body to deformation. For an elastic body with a single degree of freedom (for example, stretching or compression of a rod), the stiffness, k, is defined as $$k = \frac{F}{\delta}$$

where F is the force applied on the body and δ is the displacement produced by the force along the same degree of freedom. Examples of the blank 12 include pure element materials, such as aluminum foil; compounds of multiple elements, such as copper-zinc alloy foil; synthetic polymers, such as toughened polypropylene; natural products, such as cellulose paper (e.g., cardboard); or composites, such as polyethylene terephthalate/calcium carbonate (PET/$CaCO_3$) coextruded sheets. Other examples of the foldable material to make blank 12 include carton board (e.g., solid bleached board, solid unbleached board), white lined chipboard, liquid packaging board, folding boxboard, container board (e.g., liner board), wall paper substrates, uncoated cover paper, or the like.

An adhesion promoting layer 26 is applied to the back surface 15 of the blank 12 at least at the center portion 14. One example of the adhesion promoting layer 26 is shown in FIG. 1B. In an example, the adhesion promoting layer 26 may be a coating layer made of an interface promoter. The "interface promoter" refers to any chemical compound which is able to alter the surface energy, and thus promotes and maintains physical and chemical attachment of a bonding surface of the tabs 22 to the surface 15 at the center portion 14 where the tabs 22 are connected (see FIG. 1D). The attachment may include bonds, bridges, and/or links.

The interface promoter may be organo-metallic compounds, organo-silanes, or synthetic or natural polymers, including low molecular weight oligomers, such as dimers, trimers and tetramers. Examples of suitable organo-metallic compounds include alkoxytitanium tricarboxylates and alkoxyzirconium tricarboxylates. Examples of organo-silanes include primary amine silane, diamine silane, chloropropyl silane, mercapto silane, vinyl silane, epoxy silane, acrylate silane, and methacrylate silane. Examples of natural polymers that may be used include chemically modified starches, such as cationic or amphoteric starch; chemically modified proteins, such as cationic soybean protein; or cellulose and derivatives thereof (e.g., cellulose acetates, cellulose ethers, and cellulose esters). More specific examples of cellulose derivatives include carboxymethyl cellulose, hydroxyethyl cellulose, methyl cellulose, and methylhydroxy propyl cellulose. Examples of synthetic polymers and oligomers include polymerized succinic acid or succinic anhydride; poly(vinyl alcohol); poly(vinyl acetate); polyamide; polyimide; epoxy polyacrylates; and epoxy polymethacrylates. In some instances, the interface promoter has functional groups attached on the molecules. Examples of functional groups include hydroxyl groups, carboxyl groups, carboxylic anhydride groups, and ketene groups.

More specific examples of the organo-silane interface promoter include allyltrimethoxysilane; bis(2-hydroxyethyl)-3-aminopropyltriethoxysilane; N-(2-aminoethyl)-3-aminopropylmethyldimethoxysilane; 3-aminopropylmethyldiethoxysilane; 3-aminopropyltriethoxysilane; N-trimethoxysilylpropyl)polyethyleneimine; trimethoxysilylpropyldiethylenetriamine; 3-chloropropyltrimethoxysilane; 3-glycidoxypropyltrimethoxysilane; 1-trimethoxysilyl-2(p,m-chloromethyl)phenylethane; isocyanotopropyltriethoxysilane; 3-mercaptopropyltrimethoxysilane; 2-(diphenylphosphino)ethyltriethoxysilane; 3-methacryloxypropyltrimethoxysilane; hexamethyldisilazane; vinyltriethoxysilane; and 1,3-divinyltetramethyldisilazane.

More specific examples of the polymer interface promoter are polymers of i) acrylate addition monomers including C1-C12 alkyl acrylates and methacrylates (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl acrylate, methyl methacrylate, ethyl methacrylate, n-propyl methacrylate, isopropyl methacrylate, n-butyl methacrylate, isobutyl methacrylate, sec-butyl methacrylate, and tert-butyl methacrylate); ii) aromatic monomers (e.g., styrene, phenyl methacrylate, o-tolyl methacrylate, m-tolyl methacrylate, p-tolyl methacrylate, and benzyl methacrylate); iii) hydroxyl containing monomers (e.g., hydroxyethylacrylate and hydroxyethyl methacrylate); iv) carboxylic acid containing monomers (e.g., acrylic acid and methacrylic acid); v) vinyl ester monomers (e.g., vinyl acetate, vinyl propionate, vinyl benzoate, vinyl pivalate, vinyl-2-ethylhexanoate, and vinyl versatate); vi) a vinyl benzene monomer; or vii) C1-C12 alkyl acrylamides and methacrylamides (e.g., t-butyl acrylamide, sec-butyl acrylamide, N,N-dimethylacrylamide).

The adhesion promoting layer 26 may also include a polymeric binder and inorganic pigments with a high dispersive component of surface free energy ranging from about 50 $mJ/m^2$ to about 80 $mJ/m^2$. In an example, the interface promoter previously described may be incorporated into the adhesion promoting layer 26 with the inorganic pigments and the polymeric binder. In another example, as shown in FIG. 1C, the adhesion promoting layer 26' may be multi-layered. In the multi-layered configuration, the inorganic pigments and the polymeric binder are included in a base layer $\mathbf{26}_B$, and the interface promoter is coated as an outermost layer $\mathbf{26}_O$ on the base layer $\mathbf{26}_B$.

Examples of the inorganic pigments with the high dispersive component of surface free energy include calcium carbonates (ground or precipitated), clay, kaolin, or combinations thereof.

The polymeric binder selected provides a binding force suitable to bind the inorganic particles together and adhere the inorganic particles to the surface 15. It is to be understood that in general the polymeric binder selected has a lower dispersive component of surface free energy than that of the selected inorganic pigments. In an example, the dispersive component of surface free energy of the polymeric binder ranges from about 20 $mJ/m^2$ to about 50 $mJ/m^2$, which determines, in part, the final surface free energy of the adhesion promoting layer 26 (when included therein) or 26'. In an example, the polymeric binders are selected from polymers which have polar molecule chains and/or have a relatively high content of polar functional groups attached to the main molecule chain. Examples of these polymeric binder(s) include polyvinyl alcohol, acrylonitrile-butadiene latex, polyvinyl acetate latex, styrene-butadiene-acrylic acid copolymer latex or combinations thereof.

It may be desirable to keep the amount of polymeric binder at a minimum level, as long as adhesion is not deleteriously compromised. In an example, the adhesion promoting layer 26 (which includes the inorganic pigment and polymeric binder) or the base layer $\mathbf{26}_B$ of the adhesion promoting layer 26' includes 100 parts of a calcium carbonate pigment, 1 part of polyvinyl alcohol (PVA), and 4 parts of styrene-butadiene-acrylic acid copolymer latex. In an example when the interface promoter is included into the layer 26 with the inorganic pigment and binder, the layer 26 includes from about 1 part to about 5 parts of interface promoter per 100 parts of inorganic pigment.

Whichever adhesion promoting layer 26 or 26' is selected, it (or sub-layers $\mathbf{26}_B$ and $\mathbf{26}_O$ thereof) may be applied to the center portion 14 on the surface 15 using any suitable coating technique, such as roll coating, rod coating, film transfer coating, slot die coating, curtain coating, and spray coating. In an example, the adhesion promoting layer 26 or 26' (i.e., the sub-layers $\mathbf{26}_B$ and $\mathbf{26}_O$ together) is applied to have a total coat weight ranging from about 0.01 gsm to about 15 gsm. Some examples of the adhesion promoting layer 26 or the outermost sub-layer $\mathbf{26}_O$ of adhesion promoting layer 26' have no inorganic pigment and binder present. These example layers 26 or $\mathbf{26}_O$ may be applied to have a coat weight ranging from about 0.2 gsm to about 1 gsm. Other examples of the adhesion promoting layer 26 and the base layer $\mathbf{26}_B$ of the adhesion promoting layer 26' include inorganic pigment and binder therein. These example layers 26 or $\mathbf{26}_B$ may be applied to have a coat weight ranging from about 1 gsm to about 10 gsm.

Referring now to FIG. 1D, an example of the three-dimensional supporting frame 10 formed from the blank 12 of FIG. 1A is depicted. In FIG. 1D, speckles have been used to show the adhesion promoting layer 26 or 26' that is applied to the back surface 15 of the blank 12 at the center portion 14.

To construct the three-dimensional supporting frame 20, fold 1 of each of the extensions $\mathbf{16}_A$, $\mathbf{16}_B$, $\mathbf{16}_C$, $\mathbf{16}_D$ is folded inward (i.e., towards the surface 15). The fold 1 of a respective extension $\mathbf{16}_A$, or $\mathbf{16}_B$, or $\mathbf{16}_C$, or $\mathbf{16}_D$ forms an outer wall 1' of the respective frame portion $\mathbf{24}_A$, $\mathbf{24}_B$, $\mathbf{24}_C$, or $\mathbf{24}_D$. All together, the outer walls 1' form the exterior perimeter wall of the three-dimensional supporting frame 20. Fold 2 of each of the extensions $\mathbf{16}_A$, $\mathbf{16}_B$, $\mathbf{16}_C$, $\mathbf{16}_D$ is folded inward (i.e., towards the surface 15). The fold 2 of a respective extension $\mathbf{16}_A$, or $\mathbf{16}_B$, or $\mathbf{16}_C$, or $\mathbf{16}_D$ forms a back wall 2' of the respective frame portion $\mathbf{24}_A$, $\mathbf{24}_B$, $\mathbf{24}_C$, or $\mathbf{24}_D$. All together, the back walls 2' form the back wall of three-dimensional supporting frame 20. Fold 3 of each of the extensions $\mathbf{16}_A$, $\mathbf{16}_B$, $\mathbf{16}_C$, $\mathbf{16}_D$ is then folded inward (i.e., towards the surface 15). The fold 3 of a respective extension $\mathbf{16}_A$, or $\mathbf{16}_B$, or $\mathbf{16}_C$, or $\mathbf{16}_D$ forms an inner wall 3' of the respective frame portion $\mathbf{24}_A$, $\mathbf{24}_B$, $\mathbf{24}_C$, or $\mathbf{24}_D$. All together, the inner walls 3' form an inner perimeter wall of the three-dimensional supporting frame 20. Finally, when creating the three-dimensional supporting frame 20, fold 4 of each of the extensions $\mathbf{16}_A$, $\mathbf{16}_B$, $\mathbf{16}_C$, $\mathbf{16}_D$ is then folded inward (i.e., towards the surface 15). These folds 4 are adhered, or otherwise secure to, the adhesion promoting layer 26, 26' on the surface 15 of the blank 12 at the center portion 14.

When folds 3 and/or 4 are folded, the tab line 18' disconnects (either automatically or with application of a small force) from the blank 12 to form the tab 22. As shown in FIG. 1D, the tabs 22 may be folded away from the inner walls 3' and toward the surface 15. During the folding process, an adhesive layer may be applied to the tabs 22 (on the surface 13), and then the tabs 22 may be secured to the adhesion promoting layer 26, 26'. Alternatively, within the tab lines 18' on the surface 13 of the blank 12, the fold 3 may have an adhesive layer pre-coated thereon, and a release liner may be attached to the adhesive layer. In this example, the release liner is removed prior to securing the adhesive lined tabs 22 to the adhesion promoting layer 26, 26'.

An adhesive layer (not shown) may also be used to secure the folds 4 to the adhesion promoting layer 26, 26' on the surface 15. When folding the folds 1, 2, 3, and 4, the adhesive layer may be applied to fold 4 (or, for example, to a fold of an image receiving medium adhered to the blank 12) and then the fold 4 may be adhered to the adhesion promoting layer 26, 26' on the surface 15. Alternatively, the adhesive layer may be pre-coated onto the surface 13 of the blank 12 at the outermost fold 4, and a release liner may be attached to the adhesive layer. In this example, the release liner is removed prior to securing the adhesive lined outermost folds 4 to the adhesion promoting layer 26.

The adhesive layers may be applied to the surface 13 of the blank 12 at folds 4 or within tab lines 18 at folds 3 using an air knife coater, a rod coater, a slot die coater, a roll coater, or a film transfer coater. In one example, the adhesive layer is applied directly onto a release liner, and then the glued release liner is laminated onto the desired portion (e.g., fold 4, fold 3 within tab line 8') of the blank 12 using a laminator. The removable liner(s) may protect the adhesive layer(s) from contamination and from prematurely adhering.

Suitable adhesives that may be applied to the image receiving surface 13 are those that are capable of adhering to the back surface 15 and the adhesion promoting layer 26, 26' applied thereon. The adhesive applied to the image receiving surface 13 may be a solvent-based adhesive or a water-based adhesive. Solvents suitable for the solvent-based adhesive include heptanes, toluene, ethyl acetate, pentane-2,4-dione, and alcohols. In some instances, it may be desirable to utilize an aqueous-based water soluble and/or water dispersible adhesive. In an example, the adhesive is formed of a synthetic polymer with a weight average molecular weight ranging from about 200,000 to about 800,000 when the structure is linear, or ranging from about 300,000 to about 1,500,000 when the structure is branched or cross-linked. The adhesive may also have a pressure sensitive nature. For example, the adhesive may have a glass transition temperature ($T_g$) ranging from about −70° C. to about −40° C., and a peeling strength equal to or greater than 20 Newton/cm$^2$ (e.g., as measured according to an ASTM (f.k.a. the American Society for Testing and Materials) test method, namely ASTM 3330M using an INSTRON® tester).

Suitable examples of the adhesive are polyacrylates, polyvinyl ethers, silicone resins, polyacrylic resins, elastic hydrocarbon polymers (e.g., nitrile rubbers, butyl rubbers, polyisobutylenes, polyisoprenes, etc.), ethylene-vinyl acetate copolymers, or styrene block copolymers (e.g., styrene-butadiene-styrene (SBS), styrene-ethylene-styrene, styrene-butylene-styrene, styrene-ethylene, or styrene-propylene). Some suitable unfilled adhesive 20 may be polymers of acrylate addition monomers, such as C1 to C12 alkyl acrylates and methacrylates (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl acrylate, methyl methacrylate, ethyl methacrylate, n-propyl methacrylate, isopropyl methacrylate, n-butyl methacrylate, isobutyl methacrylate, sec-butyl methacrylate, and tert-butyl methacrylate); aromatic monomers (e.g., styrene, phenyl methacrylate, o-tolyl methacrylate, m-tolyl methacrylate, p-tolyl methacrylate, and benzyl methacrylate); hydroxyl containing monomers (e.g., hydroxyethylacrylate and hydroxyethyl methacrylate); carboxylic acid containing monomers (e.g., acrylic acid and methacrylic acid); vinyl ester monomers (e.g., vinyl acetate, vinyl propionate, vinylbenzoate, vinyl pivalate, vinyl-2-ethylhexanoate, and vinylversatate); vinyl benzene monomers; and C1-C12 alkyl acrylamide and methacrylamide (e.g., t-butyl acrylamide, sec-butyl acrylamide, N,N-dimethylacrylamide).

The adhesive applied to the image receiving surface 13 may also be a copolymer of at least two of the monomers listed herein. In an example, the molecular structure of the formed copolymer has soft segments ($T_g$ ranging from about −70° C. to about −20° C.) and small hard segments ($T_g$ ranging from about −10° C. to about 100° C.). The copolymer may also include functional monomers, i.e., the chemical groups on the molecular chain can react to form a cross-linked structure. Examples of functional monomers include methacrylic acid, acrylic acid, glycidyl methacrylate, and hydroxyethyl acrylate.

In still another example, the adhesive includes a compound having a structure of unsaturated rings. Examples of such compounds include glycerol ester of abietic acid, pentaerythritol ester of abietic acid, and terpene resins derived from alfa-pinene and beta-pinene.

The adhesive may be applied to have a coat weight ranging from 25 gsm to about 60 gsm. If the adhesive layer coat weight is less than 25 gsm, the bond strength will decrease and adhesion failure may result.

The release liner(s) may include a substrate and release coating deposited on the release coating. The substrate may be a cellulose paper and/or a polymeric film, such as polyethylene, polypropylene or polyethylene terephthalate (PET). The release coating is made of material(s) that is/are readily able to delaminate from the adhesive layer applied on desired portions of the surface 13, and do not migrate or transfer to the released material (i.e., adhesive) to any significant degree. Examples of the release coating of the release liner include polyacrylates, carbamates, polyolefins, fluorocarbons, chromium stearate complexes and silicones. In one example, the silicones release coating may be desirable, at least in part because it can easily be applied on various substrates and can be cured into a polydimethylsiloxane (PDMS) network, which limits migration into an adhesive matrix. Silicones may also allow substantially lower release forces than other materials.

Once the folds 4 and tabs 22 are secured to the adhesion promoting layer 26 on the back surface 15, the frame portions $\mathbf{24}_A$, $\mathbf{24}_B$, $\mathbf{24}_C$, and $\mathbf{24}_D$ and the three-dimensional supporting frame 20 are formed, as shown in FIG. 1D.

Figure 1E:
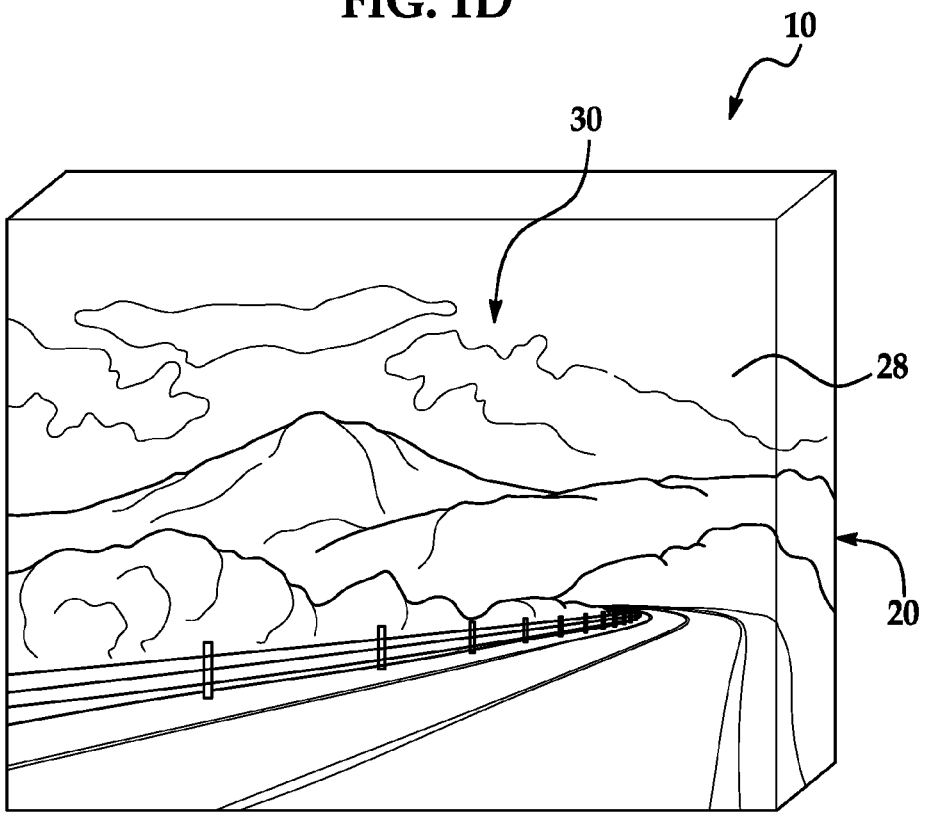
FIG. 1E is a front perspective view of an art frame formed using the three-dimensional supporting frame of FIG. 1D.

FIG. 1E depicts an example of an art frame 10 that formed from the three-dimensional supporting frame 20 of FIG. 1D. The art frame 10 includes an image receiving medium 28 adhered to a portion of the image receiving surface 13 of the three-dimensional supporting frame 20. Generally, an image 30 is printed on the image receiving medium 28, and then the image receiving medium 28 is adhered to the portion of the image receiving surface 13 of the blank 12 as it is shown in FIG. 1A, i.e., before the blank 12 is folded to form the three-dimensional supporting frame 20.

The image receiving medium 28 may be any medium that is suitable for use with any digital printing device, such as a digital inkjet printer, a liquid electrophotographic printer (a liquid toner printer), or an electrophotographic printer (a dry toner laser printed). Any of these printers may be utilized to print the image 30, which may be based upon a digital image (e.g., a digital photograph) and/or may include text and/or graphics.

The image receiving medium 28 is a foldable material which has a specific surface that is able to receive a digital image with high print quality. The specific surface may be made by coating or depositing a digital ink/toner receiving layer onto the outermost surface of a base substrate. In this example, coating or depositing refers to the application of a specifically formulated chemical composition onto the outermost surface of the base substrate of the image receiving medium by a suitable process which includes any type of coating process. The specific surface may also be made by surface treating the base substrate via a physical and/or chemical process (e.g., corona treatment, plasma grafting polymerization and/or acid etching). In this example, surface treating refers to a method for altering the surface structure or morphology chemically and/or physically without applying any foreign composition to cover the surface of the base substrate. The surface treating method modifies the nature of the base substrate surface by changing the surface morphology or changing the surface chemical functional groups.

In one example, the image receiving medium 28 includes a cellulose paper base, and the outermost surface of the cellulose paper base is surface functionalized with a digital ink/toner receiving layer. The composition of the digital ink/toner receiving layer may include binder(s) (e.g., water-based binders such as polyvinyl alcohol, styrene-butadiene emulsion, acrylonitrile-butadiene latex, or combinations thereof) and inorganic pigment particle(s) (e.g., clay, kaolin, calcium carbonate, or combinations thereof). The digital ink/toner receiving layer may be subjected to an embossing treatment to create a desirable surface texture which is represented by a lay pattern. "Lay" is a measure of the direction of the predominant machining pattern. A lay pattern is a repetitive impression created on the surface of a part. The lay patterns created on the image receiving medium 24 include, for example, vertical patterns, horizontal patterns, radial patterns, circular patterns, isotropic patterns and cross hatched patterns.

In another example, the image receiving medium 28 is made of a foldable material based on a polymeric film. Examples of suitable polymeric films include polyolefin films (e.g., polyethylene and polypropylene films), polycarbonate films, polyamide films, polytetrafluoroethylene (PTFE) films. These polymeric films can be used alone, or they can be co-extruded with another material, such as cellulose paper, to form a foldable image receiving medium. In some examples, the polymeric film surface is pre-coated with an example of the digital ink/toner receiving layer disclosed herein and/or is surface treated to improve the ink reception and toner adhesion.

In yet another example, the image receiving medium 28 is made of a foldable ductal metal foil. The metal foil may be a pure metal and/or a metal alloy. In some examples, the metal foil surface is pre-coated with an example of the digital ink/toner receiving layer disclosed herein and/or is surface treated to improve the ink reception and toner adhesion.

As mentioned above, the image 30 may be created using any suitable digital printing technique. It is believed that the durability of the printed image 30 may be the result of the combination of the medium 28 and the ink or toner that is used. For example, a medium 28 including a digital ink/toner receiving layer or having been surface treated may be desirable when digital electrophotographic printing is used with toners that contain a durable colorant and UV, light and ozone fastness resin binders. In another example, a durable printed image 30 is formed when a pigment inkjet ink is printed, using inkjet technology, onto a micro-porous image receiving medium 28. In this example, a pigment or any number of pigment blends may be provided in the inkjet ink formulation to impart color to the ink. As such, the pigment may be any number of desired pigments dispersed throughout the resulting inkjet ink. More particularly, the pigment included in the inkjet ink may include self-dispersed (surface modified) pigments, or pigments accompanied by a dispersant.

The image receiving medium 28 may be the same shape and size as the center portion 14 of the blank 12. The matching size and shape of center portion 14 and the image receiving medium 28 enable a user to easily align the two using the edge of the image receiving medium 28 and the perimeter P. In other examples, the image receiving medium 28 is the same size and shape as the center portion 14 and the innermost fold 1 of the foldable extensions $\mathbf{16}_A$, $\mathbf{16}_B$, $\mathbf{16}_C$, $\mathbf{16}_D$, or the image receiving medium 28 is the same size and shape as the center portion 14 and the two innermost folds 1 and 2 of the foldable extensions $\mathbf{16}_A$, $\mathbf{16}_B$, $\mathbf{16}_C$, $\mathbf{16}_D$. In these latter examples, the image receiving medium 28 may have an image receiving center portion that is shaped and sized in the same manner as the center portion 14 of the blank 12, and may also have image receiving extensions that respectively extend from each side of the image receiving center portion. The extensions of the image receiving medium 28 may be scored with two or three fold lines match the fold lines 18 of the foldable extensions $\mathbf{16}_A$, $\mathbf{16}_B$, $\mathbf{16}_C$, $\mathbf{16}_D$ that define the folds 1 or 1 and 2.

When the blank 12 is folded and the image receiving medium 28 covers the center portion 14 alone, the image receiving medium 28 is viewable from the front of the art frame 10, but the walls 1', 2', 3' of the three-dimensional supporting frame 20 will be viewable from other angles (e.g., from the side and back). When the blank 12 is folded and the image receiving medium 28 covers the center portion 14 and the folds 1, the image receiving medium 28 (and potentially the image 30) will be viewable from the front of the art frame 10 and along the outer walls 1' (i.e., from the side, as shown in FIG. 1E). In this example, the walls 2' and 3' of the three-dimensional supporting frame 20 will be viewable from the back. When the blank 12 is folded and the image receiving medium 28 covers the center portion 14 and the folds 1 and 2, the image receiving medium 28 (and potentially the image 30) will be viewable from the front of the art frame 10 and along the outer walls 1' and 2'. In this example, the walls 3' of the three-dimensional supporting frame 20 will be viewable from the back.

An adhesive layer (not shown) may be pre-coated onto the image receiving surface 13 of the blank 12 at the desirable areas where the image receiving medium 28 will be adhered. Any of the adhesives previously described may be utilized. When the image receiving medium 28 is the same size and shape as the center portion 14 alone, this adhesive layer may be deposited on the surface 13 at the center portion 14, but may not be deposited on the surface 13 at the foldable extensions $\mathbf{16}_A$, $\mathbf{16}_B$, $\mathbf{16}_C$, $\mathbf{16}_D$. When the image receiving medium 28 is the same size and shape as the center portion 14 and the innermost folds 1 or 1 and 2 of the foldable extensions $\mathbf{16}_A$, $\mathbf{16}_B$, $\mathbf{16}_C$, $\mathbf{16}_D$, this adhesive layer may be formed on the surface 13 at the center portion 14 and at the innermost folds 1 or 1 and 2 of each foldable extension $\mathbf{16}_A$, $\mathbf{16}_B$, $\mathbf{16}_C$, $\mathbf{16}_D$. Also as mentioned above, it is to be understood that removable/release liners may be positioned on this adhesive layer(s) until it is desirable to adhere the image receiving medium 28. In another example, instead of applying the adhesive to the image receiving surface 13, the adhesive may be applied to the image receiving medium 28 just prior to adhering the image receiving medium 28 to the blank 12.

After the image receiving medium 28 is adhered to the desired portion of the blank 12 and prior to folding, rubber rollers may be used to apply force to the adhered materials to remove any air bubbles entrapped between the adhered materials. After the image receiving medium 28 is adhered to the blank 12, the blank 12 is folded as previously described in reference to FIG. 1D. This forms the art frame 10 shown in FIG. 1E.

Figure 2:
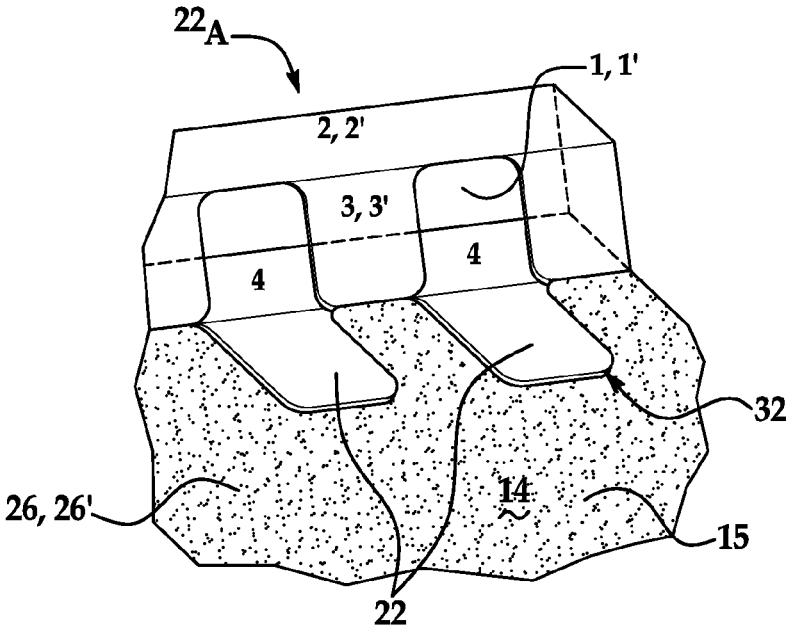
FIG. 2 is an enlarged, cut-away, perspective view of an example of a frame portion of a three-dimensional supporting frame illustrating an example of the tabs secured to the center portion.
Figure 3:
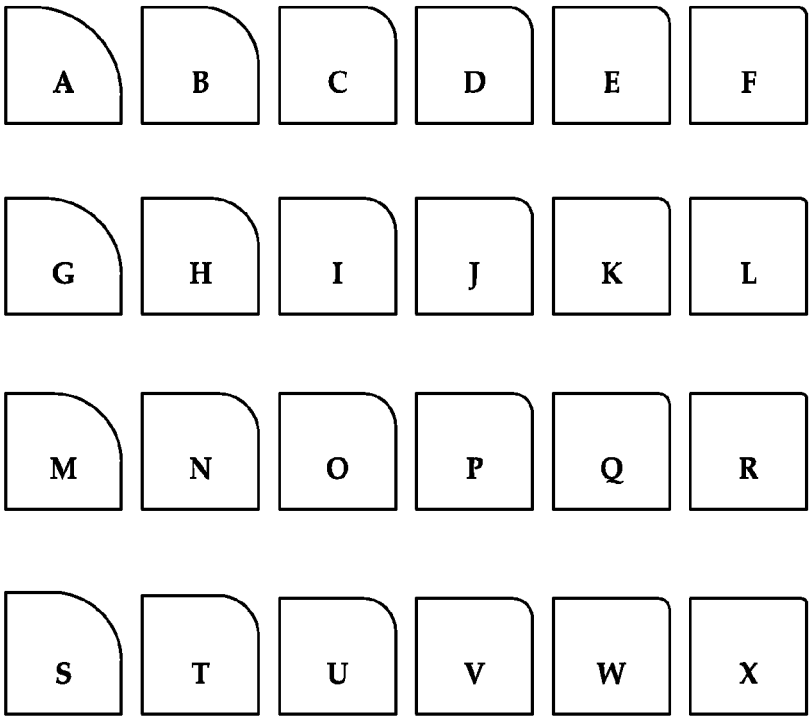
FIG. 3 is a schematic illustration of examples of various corner radii that may be used for the corners of the tabs disclosed herein.

Referring now to FIG. 2, a cut-away view of one frame portion (e.g., $\mathbf{22}_A$) is shown with the tabs 22 folded toward and secured to the back surface 15 (which has adhesion promoting layer 26 or 26' applied thereto, denoted by the speckles). Each of the tabs 22 disclosed herein has a substantially square shape or a substantially rectangular shape with rounded corners 32. The rounded corners 32 of the tabs 22 disclosed herein have a corner radius that is greater than 0. The corner radius refers to the radius of a circle created by extending the corner arc to form a complete circle. In an example, the corner radius ranges from about 0.2 inches to about 0.3 inches. In another example, the corner radius is selected from 3/16" (0.1875") or 5/32" (0.1562"). Examples of different corner radii that are suitable for the corners 32, are shown in FIG. 3. The following table sets forth the corner radius of each of the corners 32 labeled A-X in FIG. 3.

| Corner | Radius of Corner |
|---|---|
| A | 3/4" (0.75") |
| B | 1/2" (0.5") |
| C | 5/16" (0.3125") |
| D | 3/16" (0.1875") |
| E | 1/8" (0.125") |
| F | 1/16" (0.0625") |
| G | 11/16" (0.6875") |
| H | 7/16" (0.4375") |
| I | 9/32" (0.2812") |

-continued

| Corner | Radius of Corner |
|---|---|
| J | 11/64" (0.1718") |
| K | 7/64" (0.1093") |
| L | 3/64" (0.0468") |
| M | 5/8" (0.625") |
| N | 3/8" (0.375") |
| O | 1/4" (0.25") |
| P | 5/32" (0.1562") |
| Q | 3/32" (0.0937") |
| R | 1/32" (0.0312") |
| S | 9/16" (0.5625") |
| T | 11/32" (0.3437") |
| U | 7/32" (0.2187") |
| V | 9/64" (0.1406") |
| W | 5/64" (0.0781") |
| X | 1/64" (0.0156") |

The tabs 22 having rounded corners 32 are believed to provide numerous advantages, for example, over a truly square or rectangular shaped tab (with pointed corners, having a corner radius of 0). One advantage of the rounded corner 32 is that any releasable liner secured to the tab 22 (on surface 13) is easy to peel back. In other words, it is easier to initiate removal of the release liner from a rounded corner tab than a square or rectangular corner tab. Another advantage of the rounded corner 32 is that the contact area between the tab 22 and the adhesion promoting layer 26 is maximized from a geometrical calculation.

Figure 4:
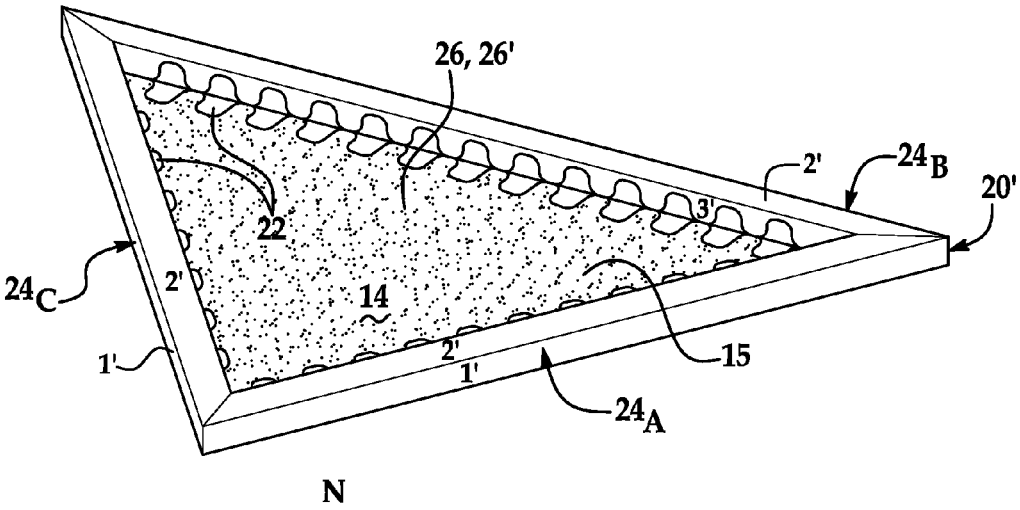
FIG. 4 is a back perspective view of an example of a triangular three-dimensional supporting frame.
Figure 5:
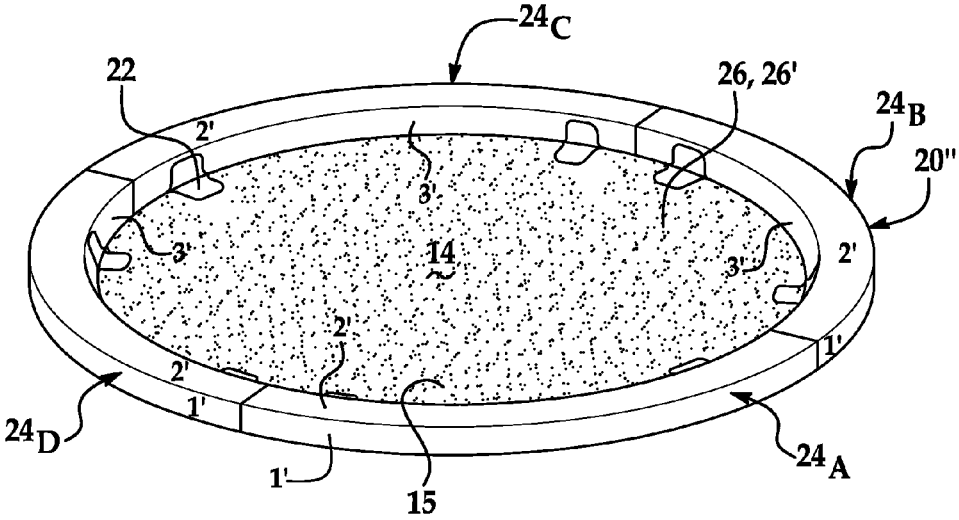
FIG. 5 is a back perspective view of an example of a circular three-dimensional supporting frame.
Figure 6:
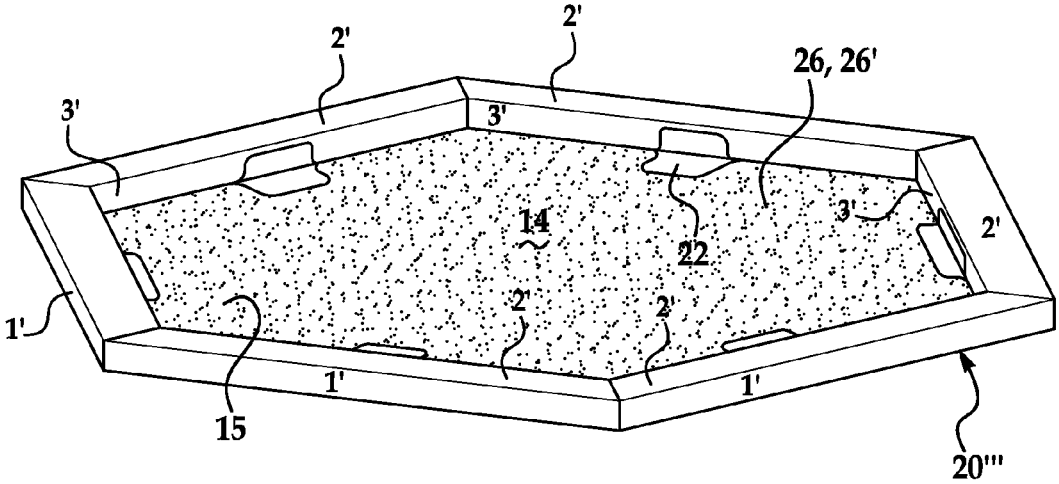
FIG. 6 is a back perspective view of an example of a hexagonal three-dimensional supporting frame.

FIGS. 4 through 6 depict three-dimensional supporting frames 20', 20", 20'" with different shapes. While not shown, the three-dimensional supporting frames 20', 20", 20'" may also include the image receiving medium 28 adhered thereto to form art frames of the shown shapes. The three-dimensional supporting frames 20',20",20'" are formed from blanks that are similar to the blank 12, but the respective center portions and foldable extensions are shaped differently.

FIG. 4 illustrates a triangular shaped three-dimensional supporting frame 20'. The three-dimensional supporting frame 20' includes three frame portions $\mathbf{24}_A$, $\mathbf{24}_B$, $\mathbf{24}_C$, which are formed from three foldable extensions $\mathbf{16}_A$, $\mathbf{16}_B$, $\mathbf{16}_C$ that have been folded in a manner similar to that described for the blank 12. The three foldable extensions $\mathbf{16}_A$, $\mathbf{16}_B$, $\mathbf{16}_C$ extend from a triangular shaped center portion 14. In the example shown in FIG. 4, multiple tabs 22 are folded toward and secured to the adhesion promoting layer 26 on the back surface 15.

FIG. 5 illustrates a circular shaped three-dimensional supporting frame 20". The three-dimensional supporting frame 20" includes four frame portions $\mathbf{24}_A$, $\mathbf{24}_B$, $\mathbf{24}_C$, $\mathbf{24}_D$ which are formed from four rounded foldable extensions $\mathbf{16}_A$, $\mathbf{16}_B$, $\mathbf{16}_C$, $\mathbf{16}_D$ that have been folded in a manner similar to that described for the blank 12. The four foldable extensions $\mathbf{16}_A$, $\mathbf{16}_B$, $\mathbf{16}_C$, $\mathbf{16}_D$ extend from a circular shaped center portion 14. In the example shown in FIG. 5, two tabs 22 per frame portion $\mathbf{24}_A$, $\mathbf{24}_B$, $\mathbf{24}_C$, $\mathbf{24}_D$ are folded toward and secured to the adhesion promoting layer 26 on the back surface 15.

FIG. 6 illustrates a polygon (e.g., hexagon) shaped three-dimensional supporting frame 20'". The three-dimensional supporting frame 20'" includes six frame portions $\mathbf{24}_A$, $\mathbf{24}_B$, $\mathbf{24}_C$, $\mathbf{24}_D$, $\mathbf{24}_E$, $\mathbf{24}_F$ which are formed from six foldable extensions $\mathbf{16}_A$, $\mathbf{16}_B$, $\mathbf{16}_C$, $\mathbf{16}_D$, $\mathbf{16}_E$, $\mathbf{16}_F$ that have been folded in a manner similar to that described for the blank 12. The six foldable extensions $\mathbf{16}_A$, $\mathbf{16}_B$, $\mathbf{16}_C$, $\mathbf{16}_D$, $\mathbf{16}_E$, $\mathbf{16}_F$ extend from a hexagon shaped center portion 14. In the example shown in FIG. 6, a single tab 22 per frame portion $\mathbf{24}_A$, $\mathbf{24}_B$, $\mathbf{24}_C$, $\mathbf{24}_D$, $\mathbf{24}_E$, $\mathbf{24}_F$ is folded toward and secured to the adhesion promoting layer 26 on the back surface 15.

It is to be understood that the ranges provided herein include the stated range and any value or sub-range within the stated range. For example, a range from about 0.2 inches to about 0.3 inches should be interpreted to include not only the explicitly recited limits of about 0.2 inches to about 0.3 inches, but also to include individual values, such as 0.24 inches, 0.275 inches, etc., and sub-ranges, such as from about 0.25 inches to about 0.27 inches, from about 0.210 inches to about 0.290 inches, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed is:

1. A three-dimensional supporting frame, comprising:

a blank, including:

an image receiving surface;

a back surface opposed to the image receiving surface;

a center portion defining a perimeter;

at least three foldable extensions extending from the perimeter, each of the foldable extensions including four folds to be folded toward the back surface to form the three-dimensional supporting frame; and a tab line scored in a third fold of each of the at least three foldable extensions, the tab line to be released to form a tab to be secured to the back surface when the folds are folded, wherein the tab has a corner radius scored in the third fold of each of the at least three foldable extensions; and an adhesion promoting layer on the back surface at the center portion.

2. The three-dimensional supporting frame as defined in claim 1 wherein the adhesion promoting layer includes an interface promoter chosen from an organo-metallic compound, an organo-silane, and a polymer.

3. The three-dimensional supporting frame as defined in claim 2 wherein the interface promoter has a functional group attached thereto, the functional group being chosen from hydroxyl groups, carboxyl groups, carboxylic anhydride groups, and ketene groups.

4. The three-dimensional supporting frame as defined in claim 2 wherein:

the adhesion promoting layer further includes an inorganic pigment and a polymeric binder; or the adhesion promoting layer includes a base layer of an inorganic pigment and a polymeric binder and an outermost layer of the interface promoter.

5. The three-dimensional supporting frame as defined in claim 1 wherein the corner radius ranges from about 1/64" to about 3/4".

6. The three-dimensional supporting frame as defined in claim 1 wherein the corner radius is chosen from 3/16" and 5/32".

7. The three-dimensional supporting frame as defined in claim 1 wherein a surface of the tab to be secured corresponds with the image receiving surface, and wherein the frame further comprises an adhesive on the surface of the tab.

8. The three-dimensional supporting frame as defined in claim 7, further comprising a release liner removably adhered to the adhesive on the surface of the tab.

9. The three-dimensional supporting frame as defined in claim 1 wherein the adhesion promoting layer has a coat weight ranging from about 0.01 gsm to about 5 gsm.

10. An art canvas, comprising:

a blank, including:

an image receiving surface;

a back surface opposed to the image receiving surface;

a center portion defining a perimeter;

at least three foldable extensions extending from the perimeter, each of the foldable extensions including four folds folded toward the back surface to form the three-dimensional supporting frame; and a tab scored in a third fold of each of the at least three foldable extensions and secured to the back surface, wherein the tab has a corner radius scored in the third fold of each of the at least three foldable extensions;

an adhesion promoting layer on the back surface at the center portion, the adhesion promoting layer increasing adhesion between the tab and the back surface;

an adhesive adhering respective portions of the back surface and each of the folds that is furthest from the perimeter;

an image receiving medium having an image printed thereon; and an adhesive adhering the image on the image receiving surface at least at the center portion.

11. The art canvas as defined in claim 10 wherein the adhesion promoting layer includes an interface promoter chosen from:

an organo-metallic compound chosen from alkoxytitanium tricarboxylates and alkoxy zirconium tricarboxylates;

an organo-silane chosen from primary amine silane, diamine silane, chloropropyl silane, mercapto silane, vinyl silane, epoxy silane, acrylate silane, and methacrylate silane; or a polymer chosen from chemical modified starches, chemically modified proteins, cellulose ethers, polymers of succinic acid, polymers of succinic anhydride, oligomers of succinic acid, oligomers of succinic anhydride, poly(vinyl alcohol), poly(vinyl acetate), polyamide, polyimide, epoxy polyacrylates, and epoxy polymethacrylates.

12. The art canvas as defined in claim 11 wherein:

the adhesion promoting layer further includes an inorganic pigment and a polymeric binder; or the adhesion promoting layer includes a base layer of an inorganic pigment and a polymeric binder and an outermost layer of the interface promoter.

13. The art canvas as defined in claim 10 wherein the corner radius ranges from about 1/64" to about 3/4".

14. The art canvas as defined in claim 10 wherein the corner radius is chosen from 3/16" and 5/32".

15. A three-dimensional supporting frame, comprising:

a blank, including:

an image receiving surface;

a back surface opposed to the image receiving surface;

a center portion defining a perimeter;

at least three foldable extensions extending from the perimeter, each of the foldable extensions including four folds to be folded toward the back surface to form the three-dimensional supporting frame; and a tab line scored in a third fold of each of the at least three foldable extensions, the tab line to be released to form a tab to be secured to the back surface when the folds are folded, wherein the tab has a corner radius scored in the third fold of each of the foldable extensions, the corner radius: i) ranging from about 1/64" to about 3/4"; or ii) chosen from 3/16" and 5/32"; and an adhesion promoting layer on the back surface at the center portion.

* * * * *